US008387287B2

(12) United States Patent
Kay et al.

(10) Patent No.: US 8,387,287 B2
(45) Date of Patent: Mar. 5, 2013

(54) PROTECTIVE COVER FOR A BICYCLE CLEAT

(75) Inventors: Marianne Kay, Encinitas, CA (US); Richard Kay, Encinitas, CA (US)

(73) Assignee: Cleatskins, Inc., Encinitas, CA (US)

( * ) Notice: Subject to any disclaimer, the term of this patent is extended or adjusted under 35 U.S.C. 154(b) by 491 days.

(21) Appl. No.: 12/570,709

(22) Filed: Sep. 30, 2009

(65) Prior Publication Data

US 2010/0107451 A1 May 6, 2010

Related U.S. Application Data

(60) Provisional application No. 61/101,636, filed on Sep. 30, 2008.

(51) Int. Cl.
*A43B 5/00* (2006.01)

(52) U.S. Cl. ..... 36/135; 36/7.1 R

(58) Field of Classification Search ..... 36/135, 36/131, 7.1 R, 7.2–7.7
See application file for complete search history.

(56) References Cited

U.S. PATENT DOCUMENTS

| | | | | | |
|---|---|---|---|---|---|
| 1,592,110 | A | * | 7/1926 | Joseph | 36/7.4 |
| 1,958,107 | A | * | 5/1934 | Merrill et al. | 36/7.2 |
| 2,207,091 | A | * | 7/1940 | Fetterling et al. | 36/7.5 |
| 2,292,770 | A | * | 8/1942 | Platkin | 36/7.2 |
| 2,958,963 | A | * | 11/1960 | Lougheed | 36/7.5 |
| 3,283,424 | A | * | 11/1966 | Struntz | 36/7.5 |
| 4,055,005 | A | * | 10/1977 | Meinhart | 36/135 |
| 4,807,372 | A | * | 2/1989 | McCall | 36/135 |
| 5,007,185 | A | * | 4/1991 | Lazarski | 36/135 |
| 5,031,342 | A | * | 7/1991 | Crook | 36/135 |
| 5,367,794 | A | * | 11/1994 | Adelstein et al. | 36/135 |
| 5,794,368 | A | * | 8/1998 | Kirby | 36/135 |
| 5,966,840 | A | * | 10/1999 | Bell et al. | 36/7.6 |
| 5,992,053 | A | * | 11/1999 | Hansen | 36/7.5 |
| 2002/0133974 | A1 | * | 9/2002 | Bartolini | 36/7.7 |
| 2004/0035026 | A1 | * | 2/2004 | Foster, Jr. | 36/135 |
| 2009/0100721 | A1 | * | 4/2009 | Gorynski | 36/135 |
| 2009/0265959 | A1 | * | 10/2009 | Herber | 36/135 |
| 2009/0288314 | A1 | * | 11/2009 | Kay | 36/91 |

* cited by examiner

*Primary Examiner* — Marie Patterson
(74) *Attorney, Agent, or Firm* — Christie, Parker & Hale, LLP

(57) ABSTRACT

A protective cover for a bicyclist cleated shoe includes a thin flexible body member arranged in a generally cylindrical shape having a hollow interior and an engagement area disposed at the interior of the body member configured to receive and retain a cleat extending from the bicyclist shoe such that the cleat is covered by the engagement area and/or the body member, where the body member is configured to be disposed on the shoe in a position of engagement in which the cleat is received and retained at the engagement area and a position of disengagement where the body member remains secured to the shoe while the cleat is free from contact with the engagement area and is exposed for attachment to a pedal of the bicycle.

9 Claims, 16 Drawing Sheets

PROTECTIVE COVER FOR A BICYCLE CLEAT

CROSS REFERENCE TO RELATED APPLICATION

This application is related to and claims the benefit of U.S. Provisional Patent Application Ser. No. 61/101,636 filed on 30 Sep. 2008, the contents of which are herein incorporated by reference in their entirety.

TECHNICAL FIELD OF INVENTION

The invention concerns cleat protective covers for cleated shoes, more particularly, a cleat protective cover for a cleated bicycling shoe.

BACKGROUND OF INVENTION

Cleated bicycle shoes capable of being securely connected to pedals are widely used to provide a more efficient means for pedaling. A system of this type is desirable because it allows the user to generate force on the upstroke as well as the down stroke of the pedal cycle.

However, once a user dismounts the bicycle device the cleated shoes provide a disadvantage. The lift in the forefoot area associated with cleated bicycle shoes disturbs the normal gait pattern. This disturbance, accompanied with the slick nature of the cleat, makes walking difficult.

Furthermore, the friction caused by walking in cleated bicycle shoes causes damage to the cleat, and significantly reduces the life of said shoe. Adding to the expense of replacing cleated bicycle shoes, many cyclists also have bicycles custom aligned after each new cleat purchase.

One solution to this problem has been for users of a cleat pedal attachment system to carry an extra pair of shoes for walking. This however, is not a practical solution for many cyclists as it necessitates the use of the bag, such as a backpack, to carry said extra pair of shoes. This is cumbersome and increases the relative weight of a cyclist, thereby increasing the work needed to propel a bicycle.

Thus, a device is needed that enhances the traction of a cleated bicycle shoe and protects the cleat of said shoe, thereby improving the ease of walking and extending the life of the shoe. All the while said device must remain lightweight and easily transportable.

BRIEF SUMMARY OF THE INVENTION

A protective cover for a bicyclist cleated shoe is provided, including a thin flexible body member arranged in a generally cylindrical shape having a hollow interior and an engagement area disposed at the interior of the body member configured to receive and retain a cleat extending from the bicyclist shoe such that the cleat is covered by the engagement area and/or the body member, where the body member is configured to be disposed on the shoe in a position of engagement in which the cleat is received and retained at the engagement area and a position of disengagement where the body member remains secured to the shoe while the cleat is free from contact with the engagement area and is exposed for attachment to a pedal of the bicycle.

Further provided herein is a protective cover for a bicyclist cleated shoe including a thin elongated flexible body member having an interior for receiving the shoe and exterior for contacting the ground and an engagement area disposed at the interior of the body member configured to receive and retain a cleat extending from the bicyclist shoe such that the cleat is covered by the engagement area and/or the body member, where the body member is configured to be disposed on the shoe in a position of engagement in which the cleat is received and retained at the engagement area.

DETAILED DESCRIPTION OF THE INVENTION

The invention provides a protecting cleat cover that both enhances traction of a cleated shoe and protects a cleat area of said shoe from damage. The cleat cover of this invention, in some embodiments, is also capable of remaining attached to said shoe during engagement of the cleat and its mated pedal; this advantageously eliminates the need for storage of the cleat cover during cycling.

Figure 1:
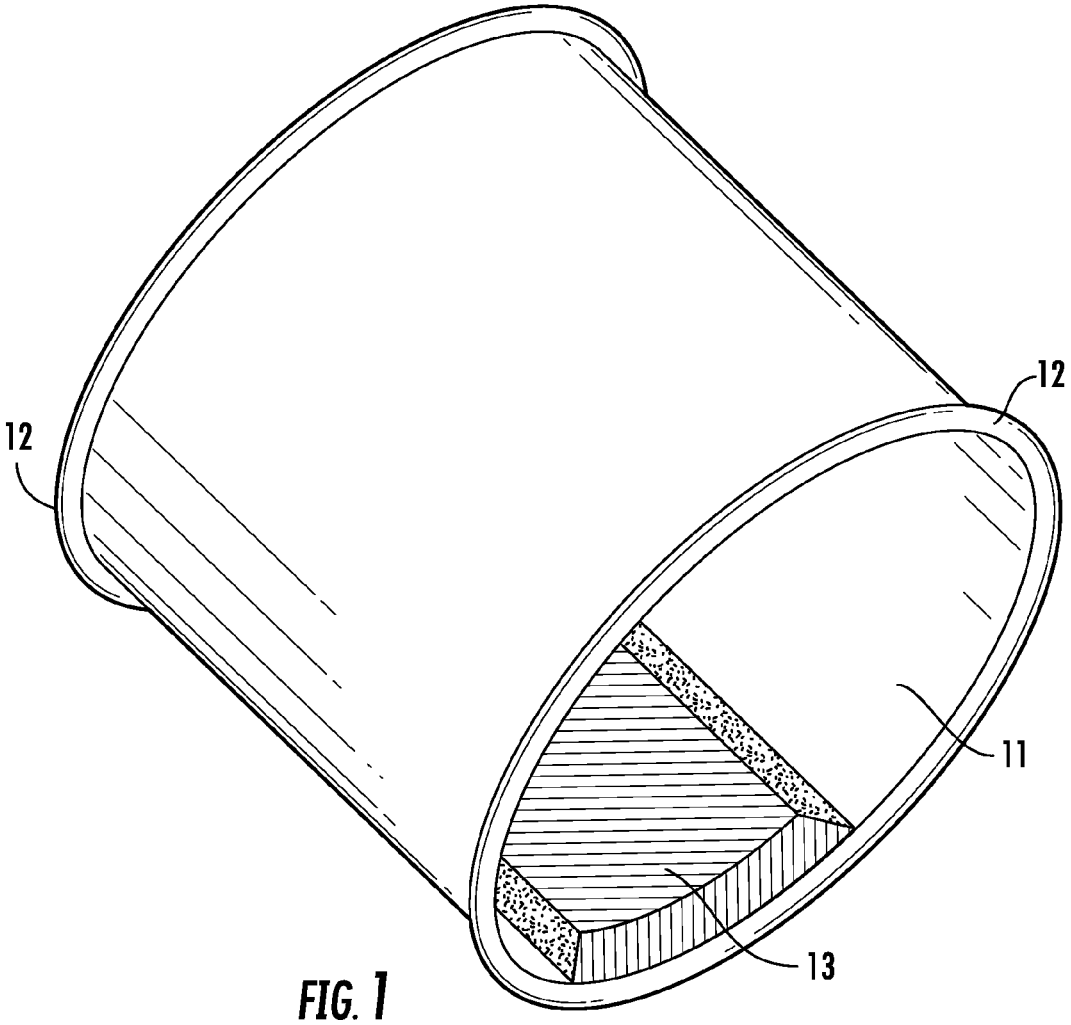
FIG. 1 is a front top view of one embodiment of a protective cover in accordance with the invention.
Figure 2:
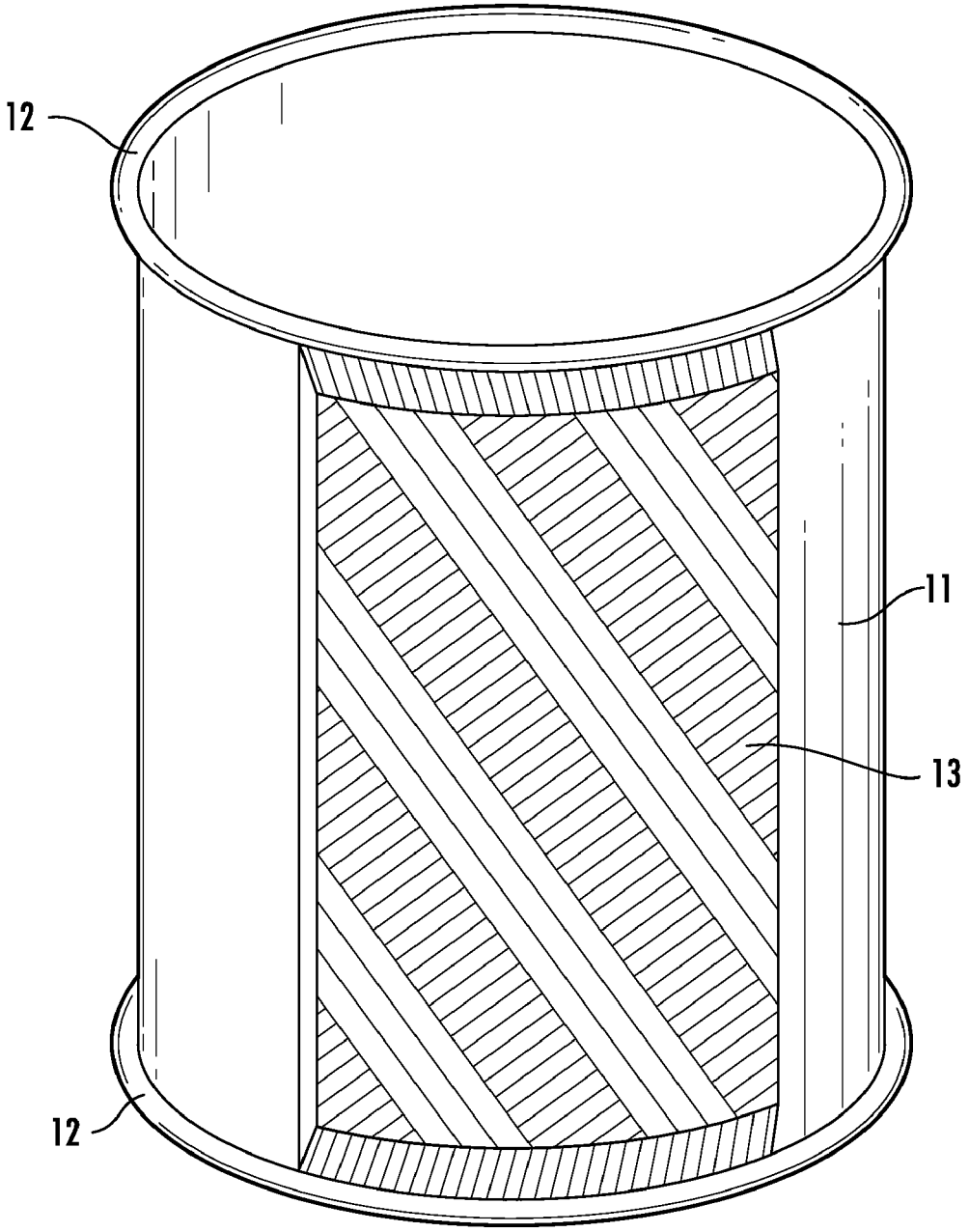
FIG. 2 is a bottom view thereof.

In FIGS. 1 and 2 a first embodiment is shown. A generally cylindrical and hollow one piece cleat protector 11 is provided. This cleat protector 11 is constructed in such a way that it can be stretched to fit over the toe of a cleated shoe and engage said shoe. The cleat protector 11 provided is of sufficient width to cover an entire cleat system of a given shoe or a given portion of said cleat system. Herein, a cleat system is understood to mean any arrangement of cleat protrusions formed on the sole or bottom of a shoe. In the cyclist context, the cleat system comprises a single cleat or lug located on the bottom of the cyclist shoe toward a front thereof, in the area of the ball of the foot. Edges of said cleat protector 11 are provided with a ridge like feature 12 configured such that each respective ridge 12 selectively engages a front and back portion of the particular cleat system. An engagement area 13 of the cleat protector 11 is designed to engage the cleat system and is constructed such that said engagement area 13 provides increased traction and provides an element of protection for said cleat system. The cleat protector 11 as a whole is capable of being moved from the position of cleat engagement to a position further towards the heal of the cleated bike shoe, thereby allowing the cleat system to freely engage with a mated pedal without removing the cleat protector from said cleated bike shoe. That is, in order to engage the cleat with the pedal, the cyclist simply slides the cleat protector backwards, up the instep of the foot until the cleat is fully exposed and thus suitable for engagement with the pedal.

As mentioned, the ridges 12 define end portions of the cleat protector 11. However, these ridges 12 could be disposed at any position along a length of the protector 11. In any event, these ridges 12 are generally configured to engage opposing ends of the cleat system or other features of the shoe sole and to secure the protector 11 upon the shoe over the cleat system. For example, these ridges 12 may be areas of increased material thickness, areas of greater or lesser elasticity, areas protruding outward relative to the remainder of the protector 11, or areas protruding inward relative to the remainder of the protector 11, or a combination thereof.

As mentioned, the engagement area 13 of the cleat protector 11 is configured to engage the cleat system so as to protect the system when the wearer is walking and to provide traction to the wearer. The engagement area 13 may comprise a generally planar surface or may be contoured to receive and engage upon the shape of a particular cleat system. This engagement area 13 may comprise a feature on the interior or exterior of the protector 11 or at the interior of the material composing the protector 11.

In use, a cyclist inserts his/her toe into one of the open ends at either side of the cylindrical cleat protector 11 and inserts the forward portion of the foot into the hollow space within the protector 11 until the engagement area 13 of the protector 11 contacts and engages the cleat system at the bottom of the cyclist's shoe. Typically, in this position, one of the ridges 12 is disposed toward the toes in front of the cleat system while the other ridge 12 is disposed in the arch area of the foot at the rear of the cleat system. In this manner, the ridges 12 secure the cleat protector 11 over the cleat system and onto the shoe of the cyclist. With the cleat protector 11 in this disposition, the engagement area 13 is engaged with the cleat of the cyclist's shoe and is positioned between the shoe and the ground as the cyclist walks. Thus, in this position, the protector 11, prevents damages associated with the bare cleat striking the ground and also provides enhanced traction to the cyclist. To engage the cleat with the pedal, the cyclist can either fully remove the cleat protectors 11 or the cyclist can simply slide the protectors 11 rearward on the foot up the instep of the shoe so to expose the cleat. In this position, the elasticity of the protector 11 secures the retracted protector 11 around the instep and arch portions of the foot. The exposed cleat may be engaged by the cyclist with the pedal for riding. The forward ridge 12 is disposed rearward of the cleat system. This helps to ensure that the protector 11 remains retracted while the cleat is engaged with the pedal. When protection of the cleat is again desired, the cyclist simply disengages the cleat from the pedal and slides the protector 11 forward over the cleat until the forward ridge 12 is in front of the cleat and the engagement area 13 has fully contacted and engaged the cleat.

Figure 3:
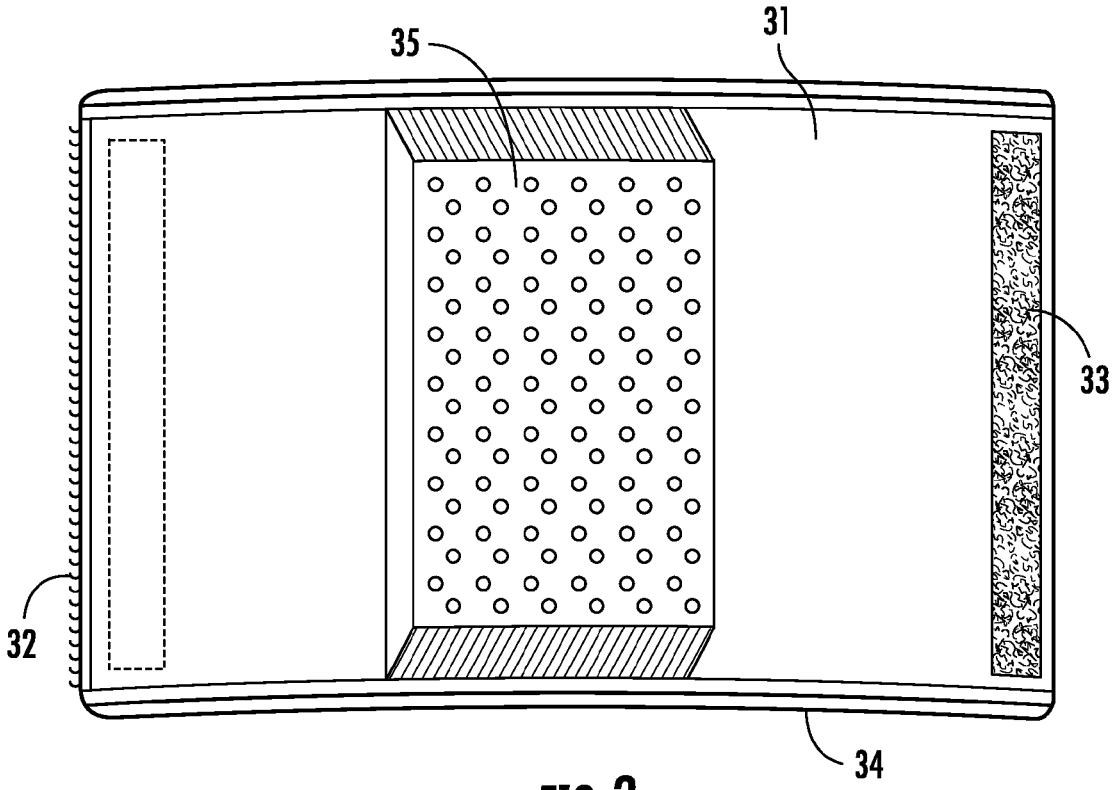
FIG. 3 is a bottom view of a another embodiment of a protective cover.

FIG. 3 shows a second embodiment of the cleat protector, which is similar to the one shown in FIGS. 1 and 2. However, this cleat protector 31 is made as a generally rectangular piece with detachable attachable means for secure placement of the cleat protector on a cleated bicycle shoe. In this embodiment a plurality of hook 32 and loop 33 detachable attachable means are provided. This embodiment comprises a similar ridge like feature 34 and cleat engaging area 35 as the first embodiment.

FIGS. 4-7 show a cleat protector 100 in another embodiment of the invention. The protector 100 includes a flexible substantially planar body 102 having an under foot portion 104 and an over foot portion 106. As the names imply, the under foot portion 104 is generally disposed beneath the shoe of a user, i.e., adjacent the sole, when worn whereas the over foot portion 106 is generally disposed adjacent to the upper of the shoe, opposite from the sole. Of course, each portion 104 and 106 may overlap somewhat onto the upper and/or sole portion of the shoe, when the protector 100 is worn. The under foot portion 104 includes a engagement area 108 similar to the engagement area 11 discussed hereinabove. That is, the engagement area 108 is configured to receive and engage a cleat system on the sole of the shoe of the wearer. The over foot portion 106 extends from one end of the under foot portion 104 and generally has a width less than that of the under foot portion 104. The over foot portion 106 is essentially a strap arrangement configured to extend across the top of the foot of the wearer and configured to engage a securement feature 110 disposed at the opposite end of the under foot portion 104. In this exemplary embodiment, the securement feature is a ring affixed to the under foot portion 104 and extending therefrom. Here, the over foot portion 106 includes a hook and loop attachment arrangement, such as that commercially known as VELCRO®, such that an end of the over foot portion 106 may be threaded through the ring 110 and folded back upon itself such that the hooks and loops are engaged and the over foot portion 106 is removably secured to the under foot portion 104.

Figure 4:
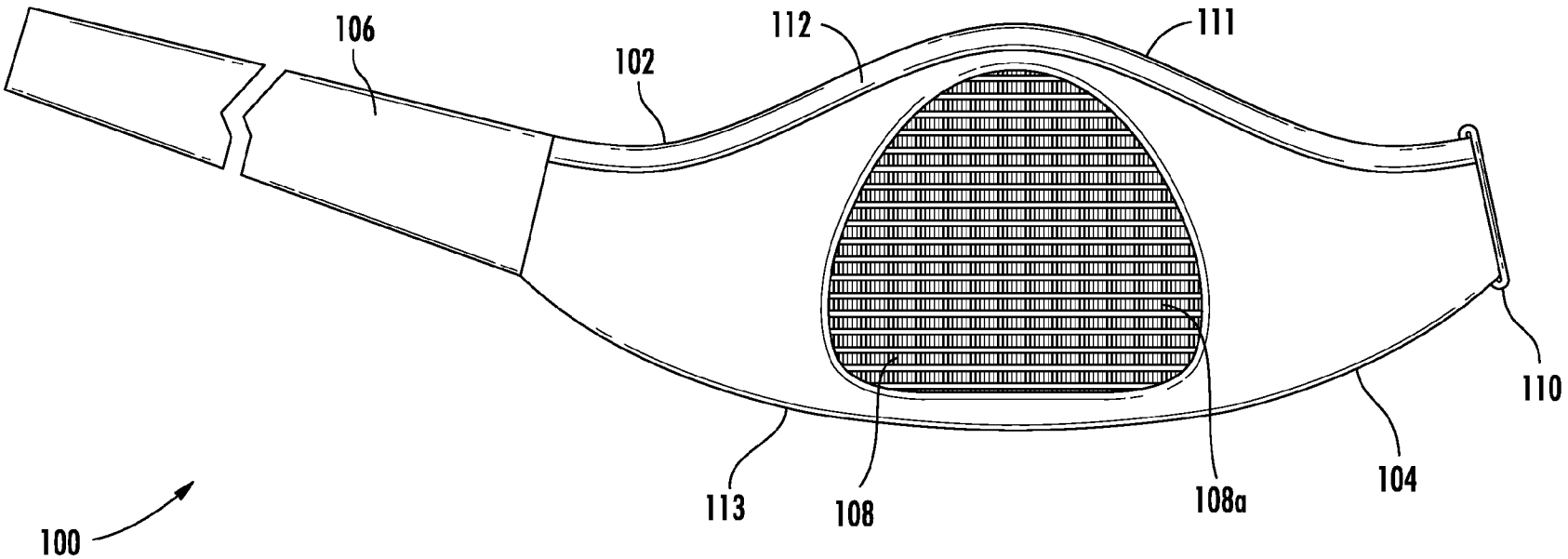
FIG. 4 is a bottom view of another embodiment of a protective cover.
Figure 5:
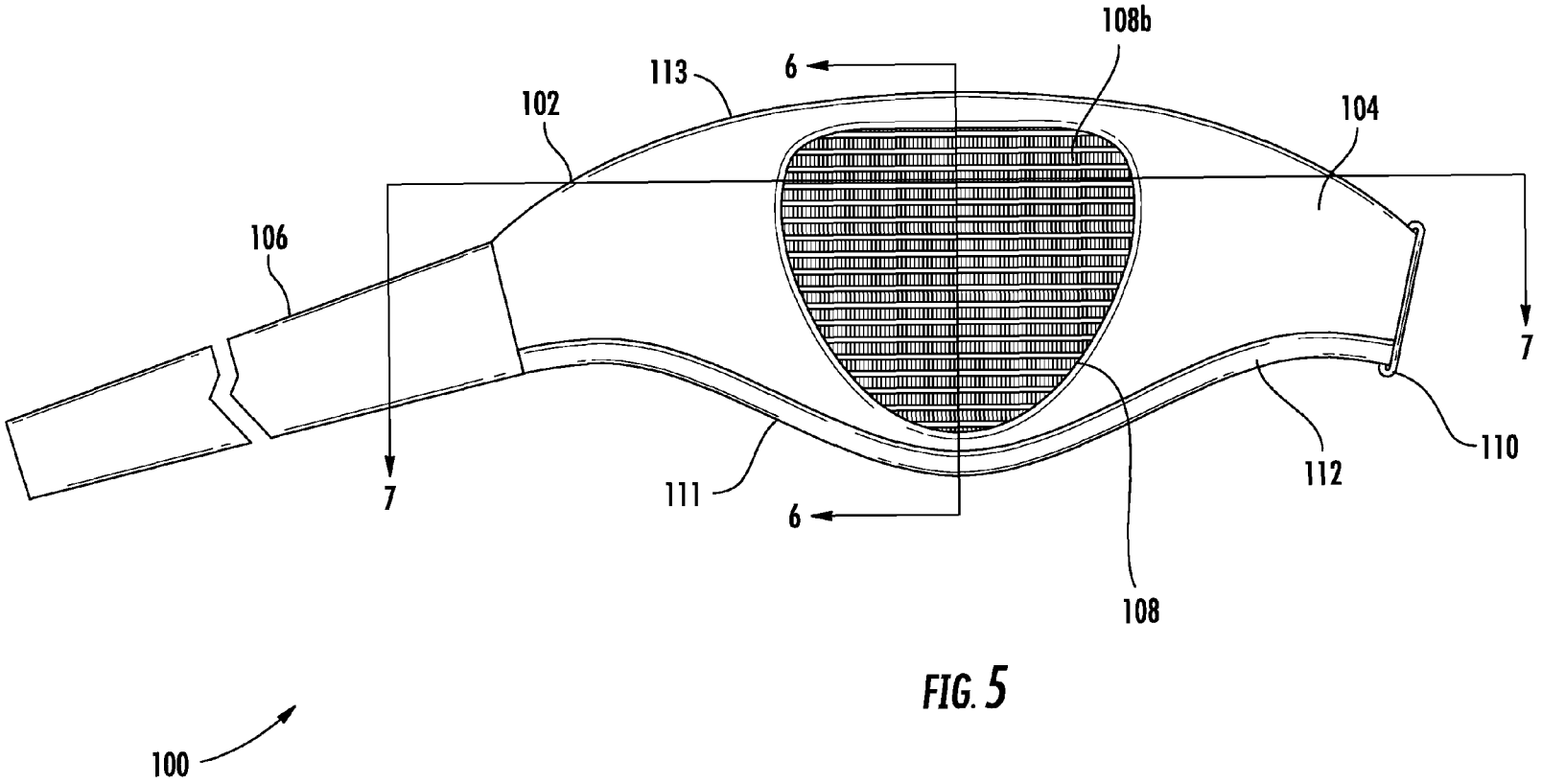
FIG. 5 is a top view thereof.
Figure 6:
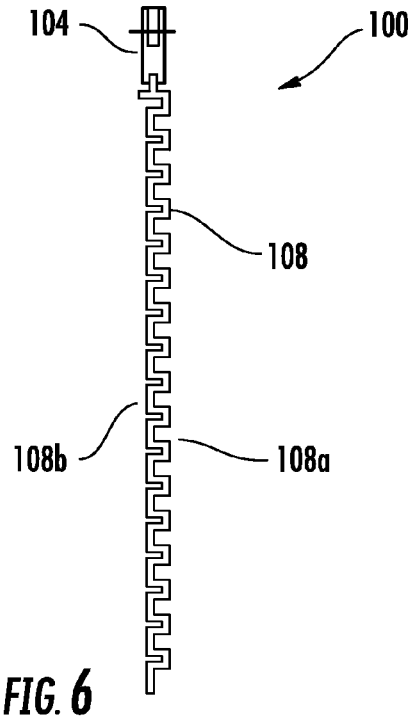
FIG. 6 is a cross sectional view thereof taken along the axis BB of FIG. 5.
Figure 7:
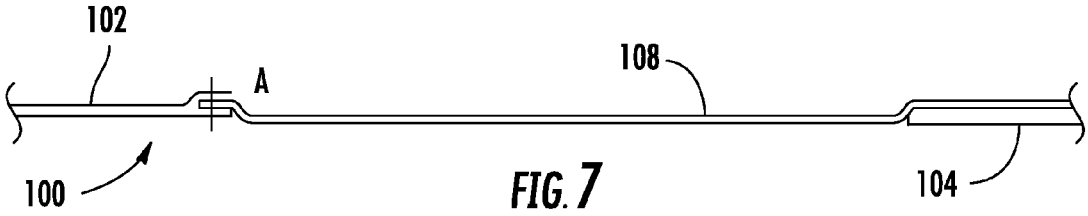
FIG. 7 is a cross sectional view thereof taken along the axis AA of FIG. 5.

The engagement area 108 is essentially a section of the under foot portion 104 which is configured to engage the cleat system of the wearer's shoe, to be secured thereupon, to protect the cleat from damage associated with the cleat contacting the ground during walking, and is further configured to provided traction to the wearer. In the illustrated exemplary embodiment, the area 108 is generally planar and is disposed at an opening of the under foot portion 104 and is secured thereto such that a first side **108*a* of the engagement area 108 is exposed at an outer surface of the protector 100, as seen in FIG. 4, and a second opposite side 108*b* is exposed at an inner side of the protector 100, as seen in FIG. 5. The outer side 108*a* includes traction features 112, such as ribbing, to provide increased traction to the wearer as the outer side 108*a* bears against the ground during walking. In the illustrated example, the traction features 112 comprise parallel ribs which extend linearly across the outer side 108*a* of the engagement area 108. The ribs are essentially grooves set into a thickness of the material forming the area 108. In other embodiments, the ribs may be linear, curvilinear, or a combination thereof. Alternatively and/or additionally, the traction features 112 of the outer side 108*a* may include protrusions such as lugs, etc. The inner side 108*b* of the engagement area 108 may include a smooth surface or may include contouring to facilitate engagement of the area 108 with the cleat system of the user's shoe. In the exemplary embodiment shown, the inner surface 108*b*** includes ribbing which comprises parallel linear insets extending across the surface.

The cleat protector 100 includes a forward edge 111 and an opposing rear edge 113, as illustrated. The forward edge 111 is disposed such that it is positioned proximate to the toes when the cleat protector is worn. The rear edge 113 is positioned proximate to the arch and instep when the protector 100 is worn. The forward edge 111 includes a ridge 112 similar to the ridge 12 discussed hereinabove. Both of the forward edges 111 and 112 have a curved profile when viewed as, for example, in FIG. 4. The forward edge 111, in this example, has a more significantly curved profile than the rear edge 112. This allows the forward edge 111 to better conform to the shape of the forward portion of the foot.

Figure 8:
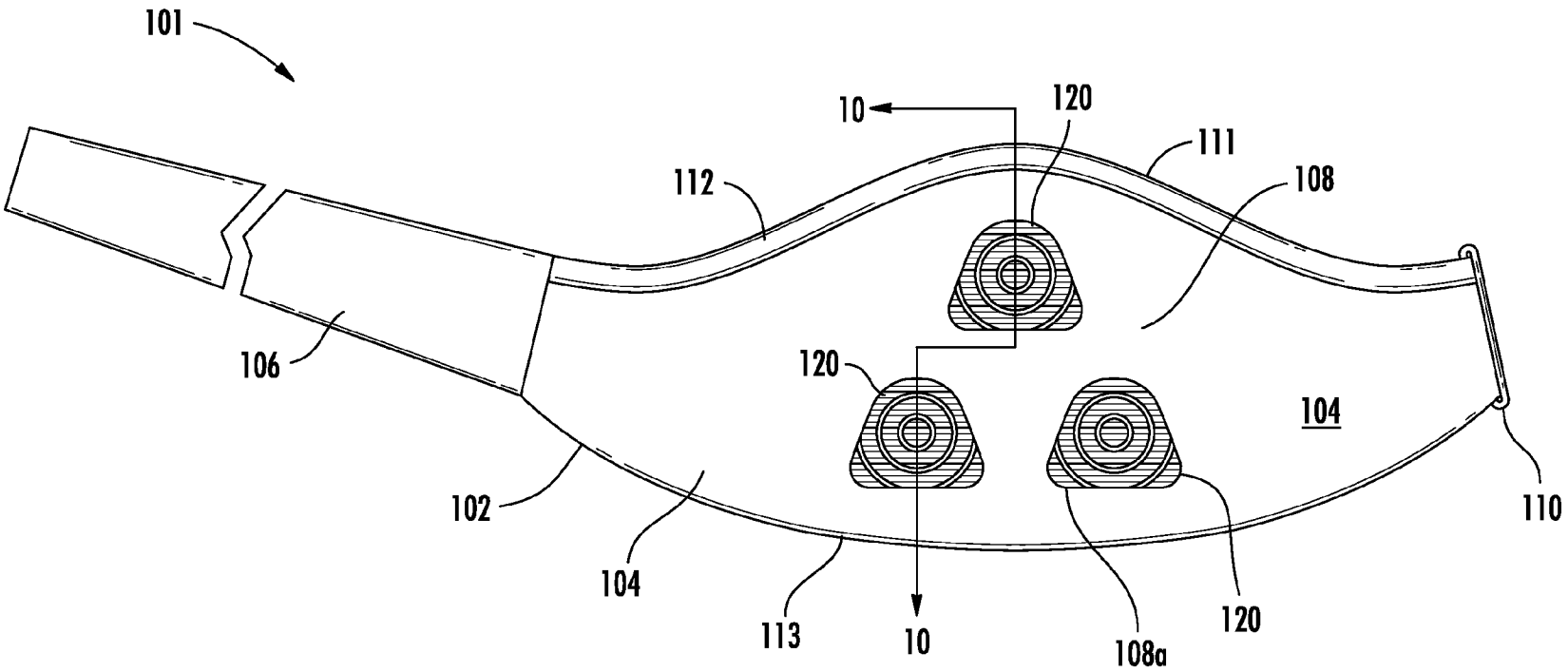
FIG. 8 is a bottom view of another embodiment of a protective cover.
Figure 9:
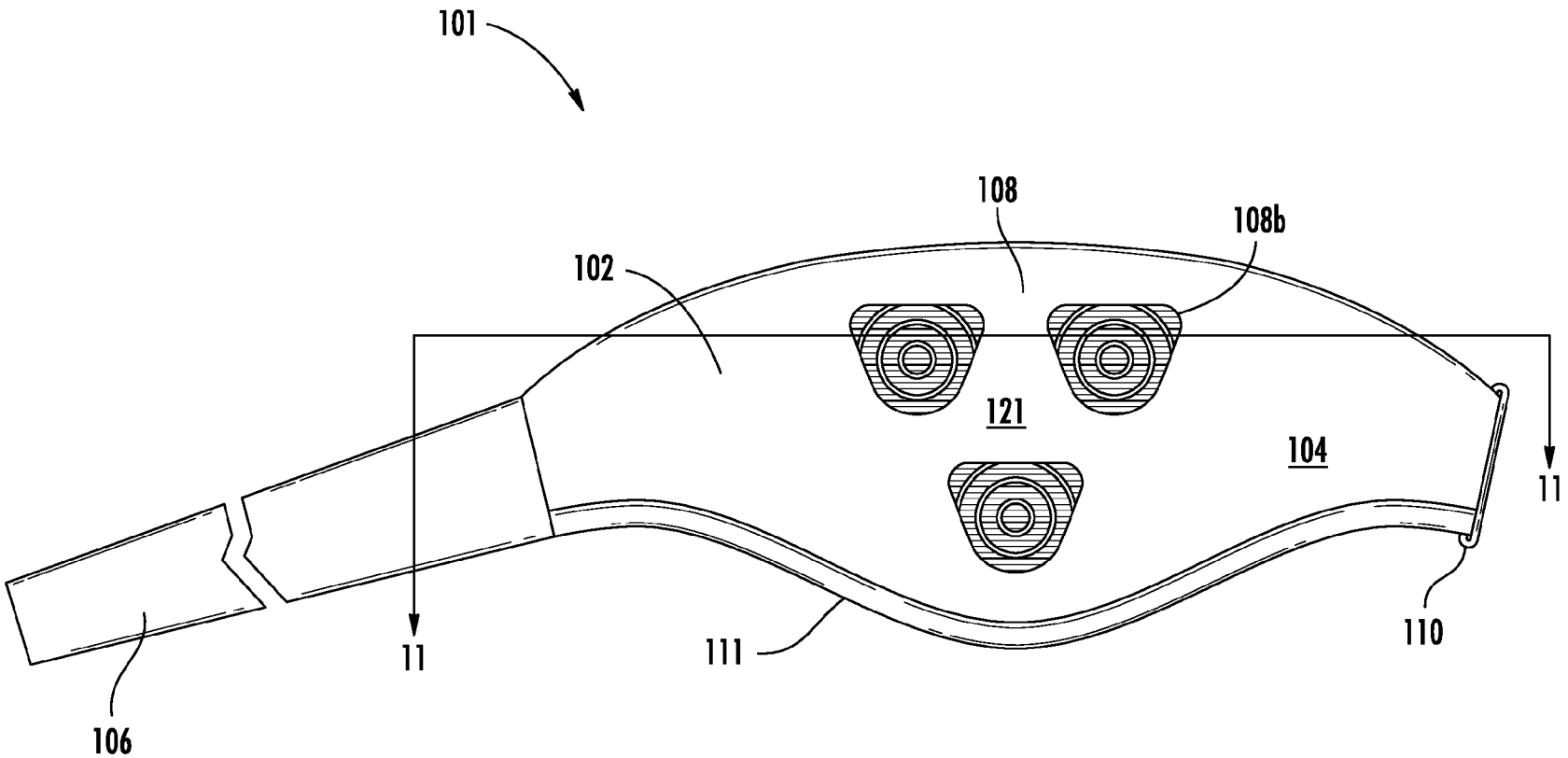
FIG. 9 is a top view thereof.
Figure 10:
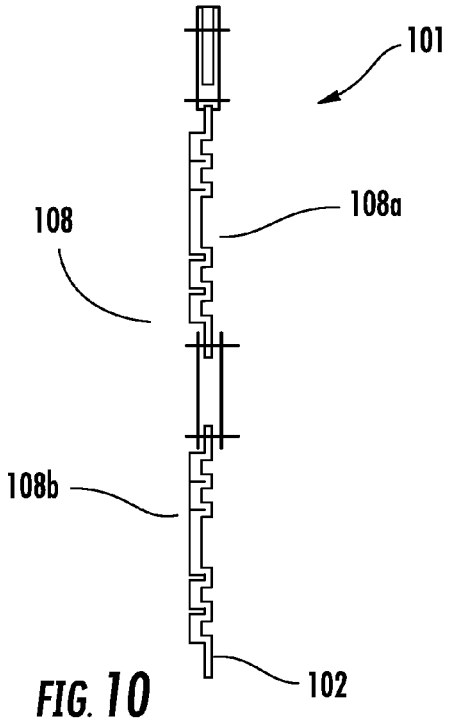
FIG. 10 is a cross sectional view thereof taken along the axis BB of FIG. 8.
Figure 11:
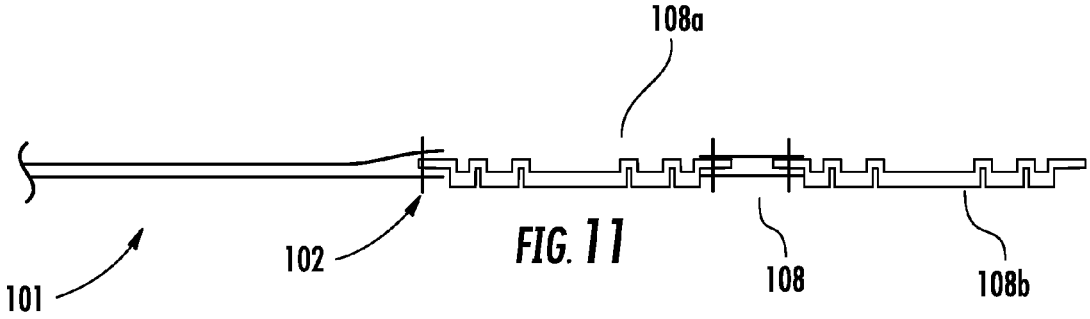
FIG. 11 is a cross sectional view thereof taken along the axis AA of FIG. 9.

FIG. 8 illustrates an exemplary cleat protector 101 in accordance with the disclosed invention. The protector 101 is similar in many ways to the protector 100 discussed above. In order to identify similar features, consistent reference numerals are used where appropriate between the protectors 100 and 101. The main difference between the protector 100 and the protector 101 lies in the construction of the engagement area 108 of the latter. In the cleat protector 101, the engagement area 108 includes a plurality of individual engagement surfaces 120. In the example shown, the area includes three engagement surfaces 120 arranged in a triangular pattern. Each surface 120 is disposed in a hole formed through the body 102 of the protector 101 and each surface 120 is affixed immovably to the body 102 at said hole. In this way, an outer surface 108*a* of the engagement surfaces 120 is exposed on one side of the cleat protector 101 and an inner side 108*b* of the surfaces 120 is exposed on the opposite side of the protector 101. One or both of the inner and outer sides 108*b*, 108*a* of the individual surfaces 120 may be configured to include ribbing, tread, lugs, and/or other contouring in order to facilitate engagement of the inner side 108*b* with the cleat system of the user and to provide traction of the outer surface 108*a* when contacting the ground during walking. The plurality of individual engagement surfaces 120 may be arranged to contact and engage the cleat system directly, as discussed, or the surfaces 120 may be alternatively arranged such the cleat system is received at an area 121 delimited by the surfaces 120 where the surfaces 120 contact an outer perimeter of the cleat system to thus engage the cleat system.

Figures 14, 15:
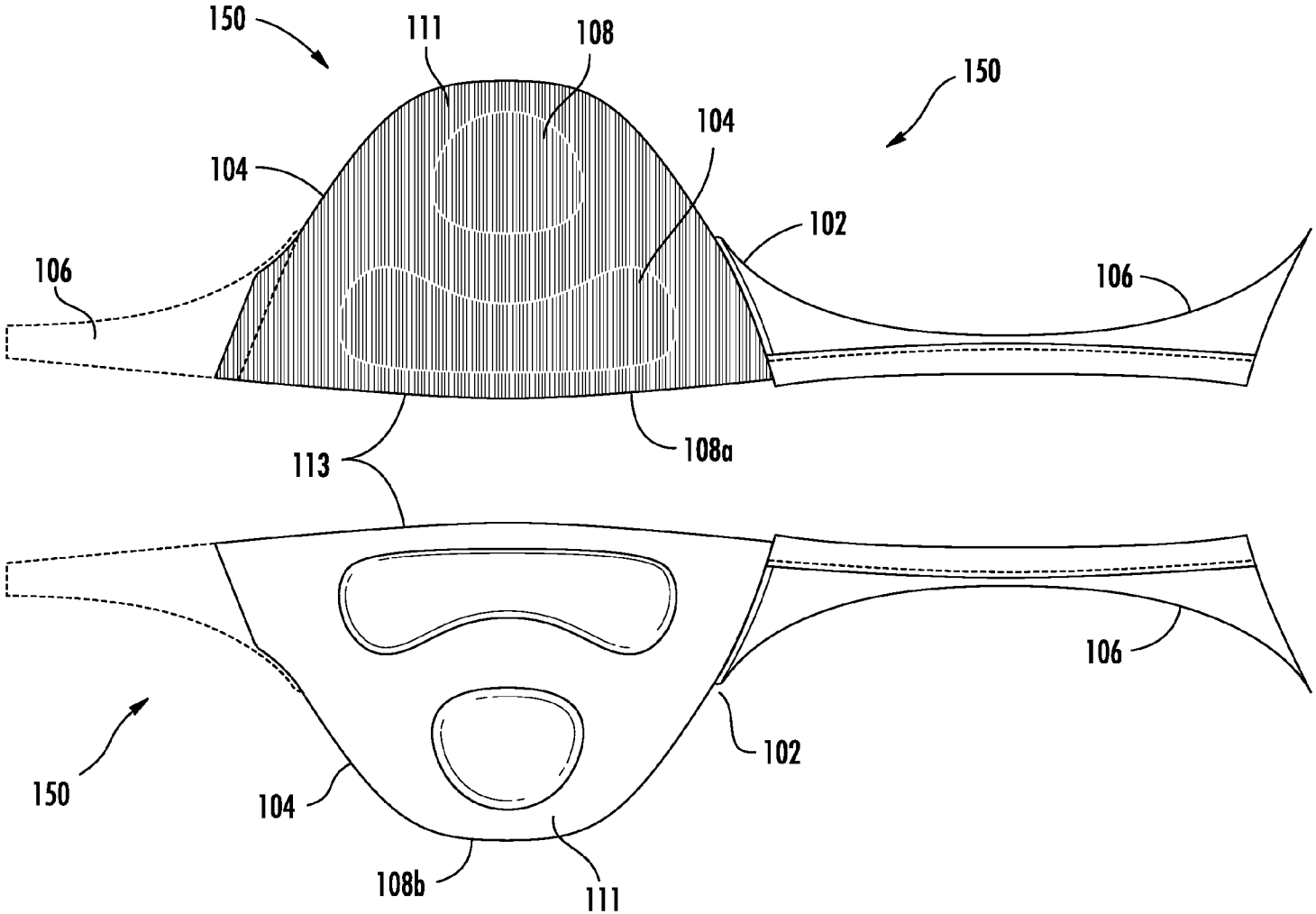
FIG. 14 is a bottom view of another embodiment of a protective cover.
FIG. 15 is a top view thereof.
Figure 16:
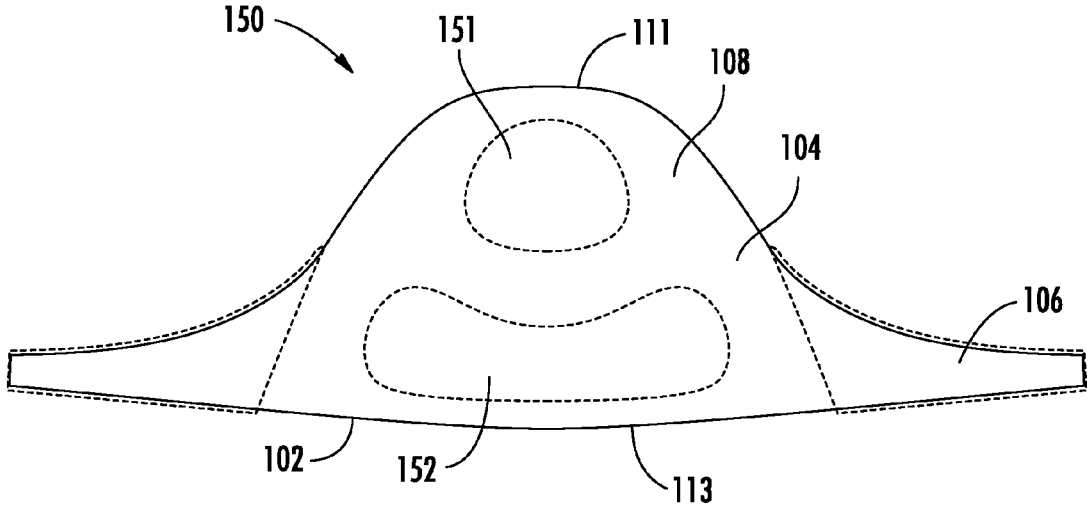
FIG. 16 is another view thereof.

FIGS. 14-16 show a cleat protector 170 in another embodiment of the disclosed invention. The protector 170 includes many of the features described previously; these are identified with consistent reference numerals and are not herein reintroduced. The over foot portion 106 of the protector 150 is fixed to opposing sides of the under foot portion. The protector 150 is shown in the drawings in a flat orientation, for simplicity. Thus, a left side of the over foot potion 106 is shown as connected to the under foot portion 104. In use, the right side of the over foot portion 106 is connected to the opposite side of the under foot portion 104—this is shown by a dashed line representation in the drawings. The over foot portion is flexible and stretchable and is configured to expand to fit over the shoe of a user as discussed with respect to the protector 11. The engagement area 108 of the protector 150 includes two individual engagement surfaces 151 and 152. See, FIG. 16. The surface 151 is generally oval in shape whereas the surface 152 is more elongated. The surfaces 151 and 152 are shaped and contoured to receive and engage the cleat system of the shoe of a user and also to provide protection to the cleat and traction to the user when worn. In use, the cleat protector 150 is applied to the show and utilized therewith similarly to that described above with respect to the protector 11; reference is made thereto.

Figure 17:
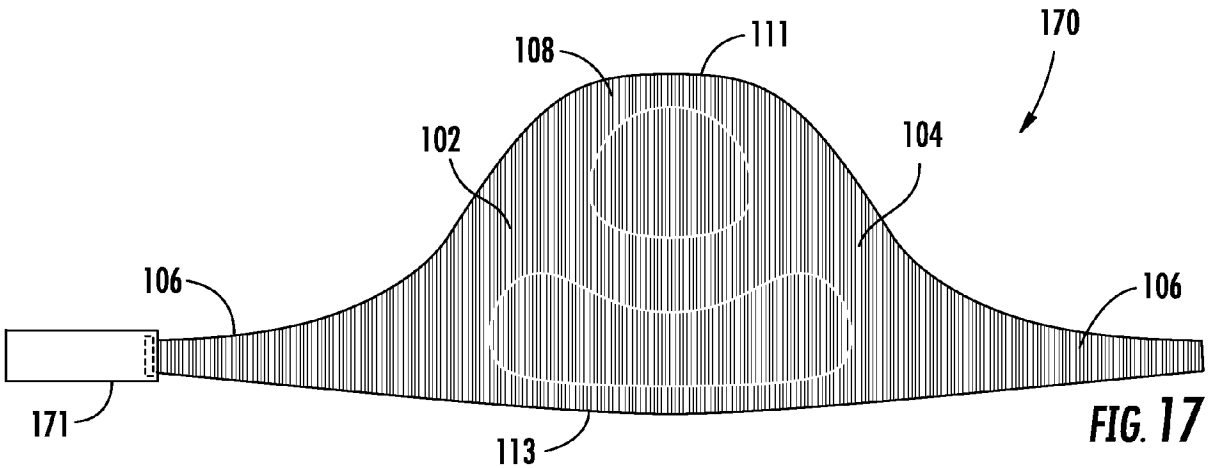
FIG. 17 is a bottom view of another protective cover.
Figure 18:
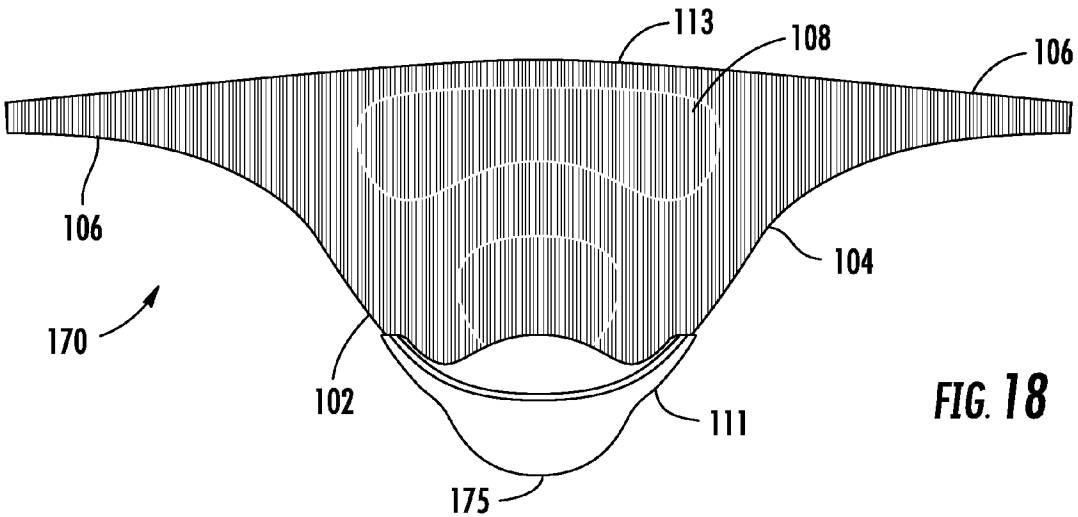
FIG. 18 is a top view thereof.
Figure 19:
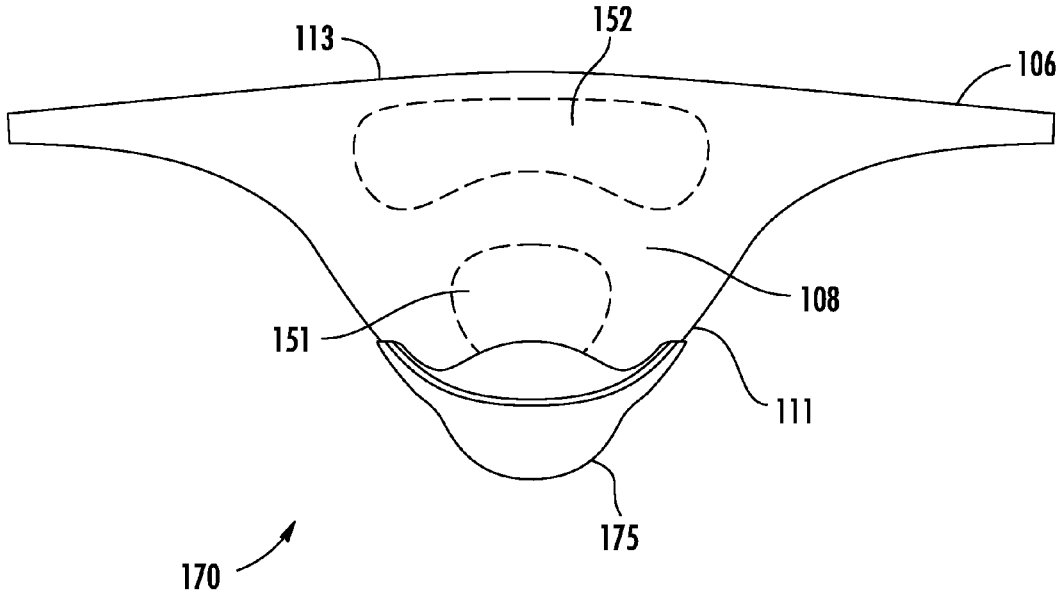
FIG. 19 is another view thereof.
Figure 20:
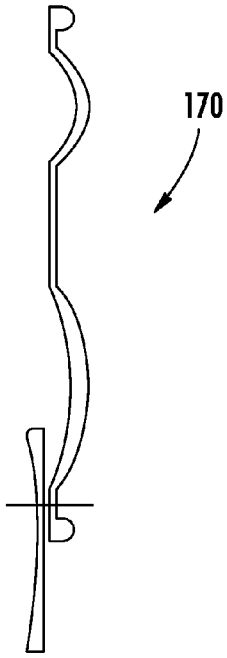
FIG. 20 is a cross sectional view thereof.

FIGS. 17-19 show a cleat protector 170 which is similar to the protector 150 but instead of including a fixed stretchable over foot portion 106 as in the protector 150, the current protector 170 includes an over foot portion 106 extending from either side of the under foot portion 104 where a securing clasp 171 is provided at one end of the over foot portion 106. When the protector 170 is worn, the clasp 171 is used to selective secure the protector onto the foot by affixing together the two free ends of the over foot portion 106. The clasp 171 folds over so as to surround and engage the ends of the over foot portion 106. The cleat protector 170 further includes a toe tab 175 disposed at the forward edge 111 thereof where the tab 175 is configured to engage the toe portion of the shoe when the protector is worn to provide a more secure fit of the protector 170 onto the shoe and also to provide protection of the toe portion of the shoe. The toe tab 175 may be formed integrally with the body 102 of the protector or it may be a separate part affixed by known methods to the forward edge 111 of the cleat protector 170.

The use of cleat protectors 100, 101, and 150 will now be discussed. As discussed in detail, these protectors 100, 101, and 150 are configured to fit on a shoe of a user, preferably on a cyclist shoe. The protectors 100, 101, and 150 each include an under foot portion 104 and an over foot portion 106. These portions 104 and 106 are essentially configured to wrap the forefoot area of the shoe of the cyclist. That is, when worn, the cleat protectors cover a region of the shoe corresponding to the ball of the foot as well as a portion of the instep and the adjacent sides of the foot. To don the cleat protectors 100, 101, and 150, the cyclist places the under foot portion 104 beneath the shoe and adjacent with the cleat system at the bottom of the shoe. The over shoe portion 106 is then positioned across the instep and secured there on by way of any of the exemplary various techniques mentioned above. For example, the over foot portion 106 of the protector 100 is threaded through the ring 110 and folded back upon itself to engage the hook and loop securement means, thus fastening the protector 100 firmly upon the foot. The cleat system of the particular shoe is fully engaged with the protector 100 at the engagement area 108 and thus the cleat is fully covered by the under foot portion 104. In this way, the cleat is protected from contact with the ground during walking and, further, traction is provided to the cyclist. When the cyclist desires to mount the bicycle and engage the cleats of the shoes with the respective pedals, the cyclist may simply detach the over shoe potion 106 and remove each cleat protector 100, 101, and 150. The protectors may then be stored during cycling and donned again when the cyclist dismounts. Alternatively, the cleat protector 100, 101, and 150 may remain on the cyclists shoes during cycling. Similarly to the protector 11, the current protectors 100, 101, and 150 may simply be maneuvered rearwardly toward the heel of the cyclist so as to expose the cleat system at the forward edge 111 of the protectors 100, 101, 150 to thus enable attachment of the cleat to the respective pedals, while the protector 100, 101, and 150 remain on the shoe. To further facilitate this, the cyclist may choose to loosen the securement of the over foot portion 106 upon the shoe to ease the rearward displacement of the protector 100, 101, 150. For example, with the protector 100, the cyclist may temporarily detach the hook and loop arrangement, loosen the fit of the protector 100 upon the shoe, and then slide the protector rearward into the storage position. When retracted as such, the cyclist may choose to tighten the over foot portion 106 by the method described above.

Figure 12:
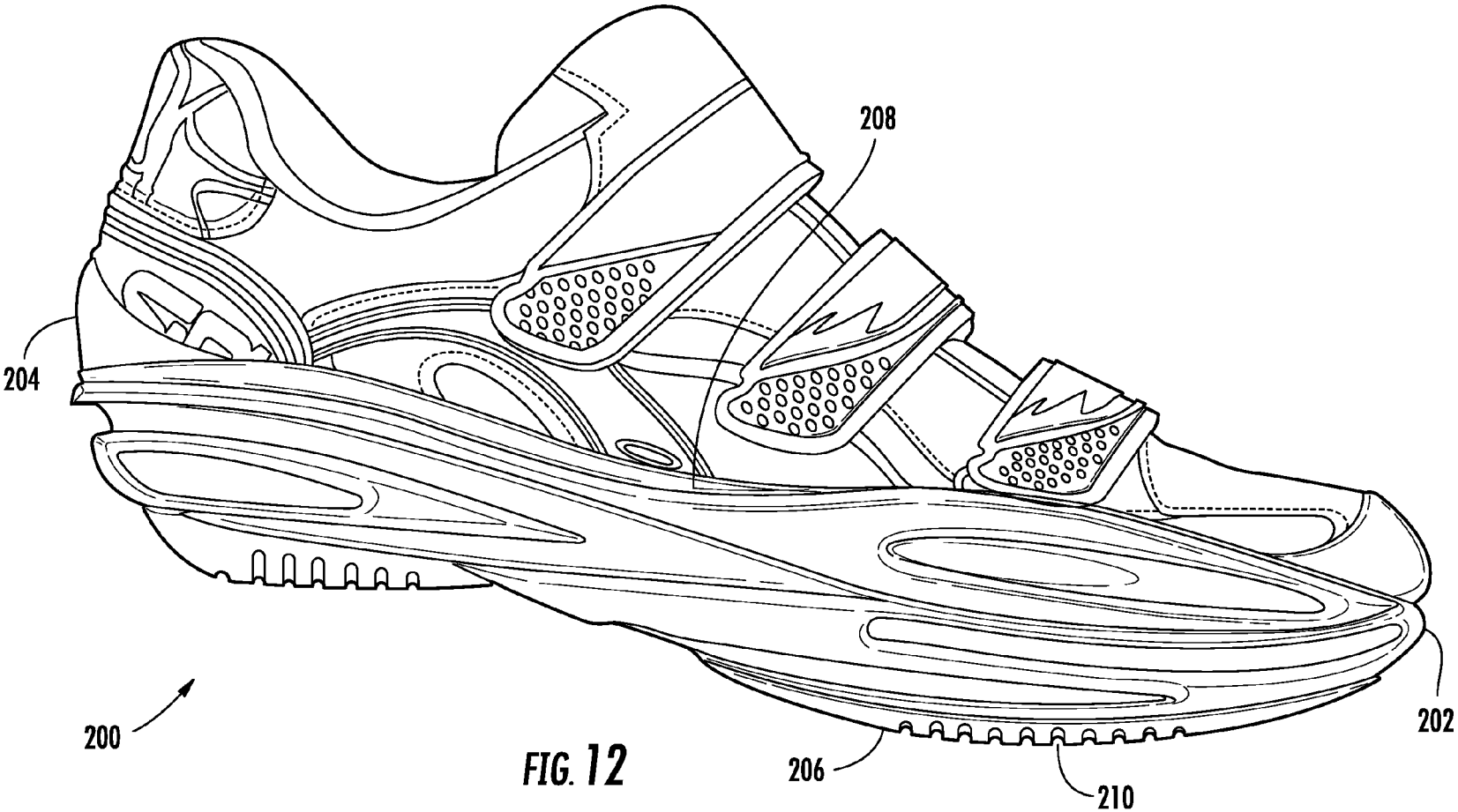
FIG. 12 is a side view of another embodiment of a protective cover.
Figure 13:
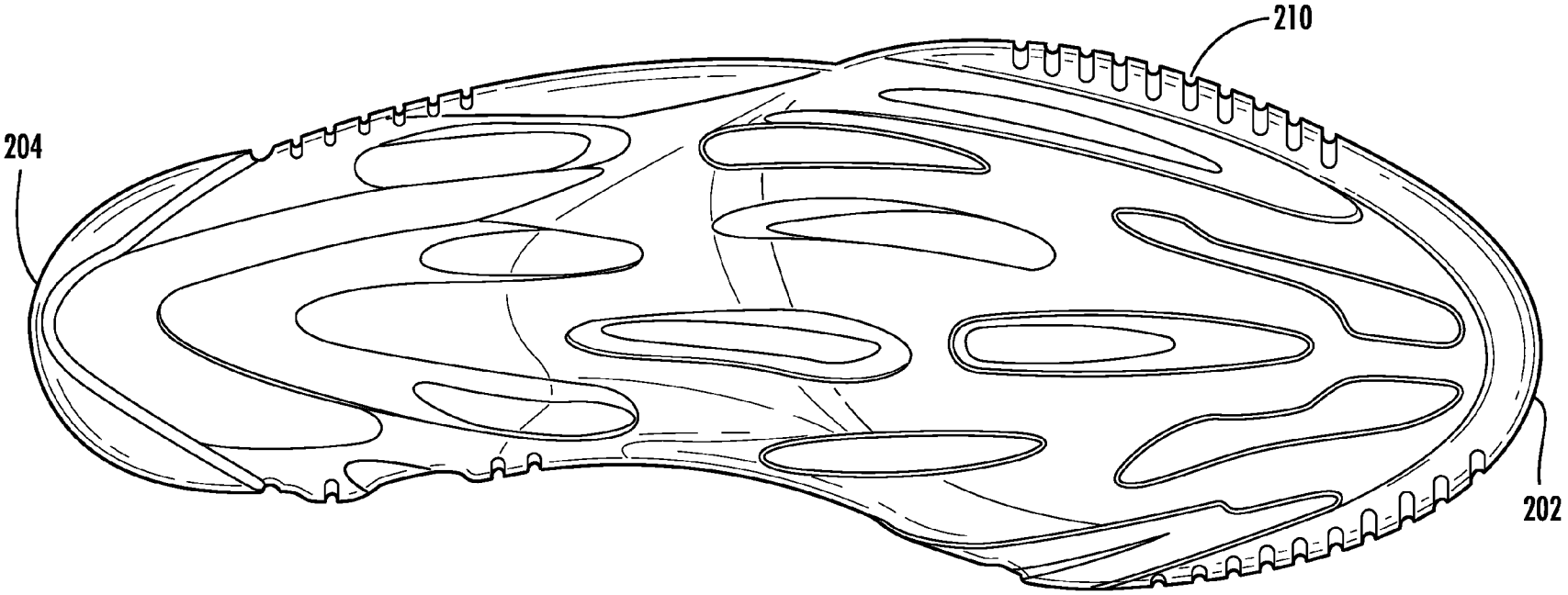
FIG. 13 is a top view thereof.

FIGS. 12 and 13 illustrate an alternate embodiment of a cleat protector 200. Here, the protector 200 encases the lower portion of the shoe to provide protection to the underlying cleat system during contact with the ground and also to provide enhanced traction and comfort to the wearer. The protector 200 includes forward end 202, an opposing rear end 204, a bottom 206, and an upper perimeter 208. The forward end 202 wraps the front of the toes and also extends upward and over a portion of the tops of the toes. The rear end 204 wraps the heel and extends upwardly thereon. The bottom 206 is continuous between the forward and rear ends 202 and 204. The bottom 206 includes treads 210 to provide enhanced traction to the wearer. The bottom 206 may include contouring, as that discussed above, such that the bottom is better configured for engaging the cleat system of a cleated shoe. The upper perimeter 208 is configured to extend on the medial and later sides of the foot from the forward end 202 to the rear end 204. The upper perimeter 208 extends at least partially up the lateral and medial sides from the bottom 206.

In use, a cleated shoe, and particularly a cleated cyclist shoe, is inserted preferably toe first into the forward end 202 of the protector 200. The toe portion of the shoe is engaged and partially encased at the front end. This disposition aligns the cleat system on the bottom of the shoe with the contouring at the interior of the bottom 206 and engages therewith. The rear end 204 of the protector 200 is then stretched backward until it is disposed around the heel of the shoe. The elastic, stretchable nature of the protector 200 ensures a snug fit of the protector 200 on the shoe. Once donned, the protector 200 provides protection to the cleat system during ground contact and also yields traction to the cyclist during walking. To remove the protector 200, the cyclist simply pulls downwardly on the front or rear 202, 204 to disengage the protector from the foot.

Figure 23:
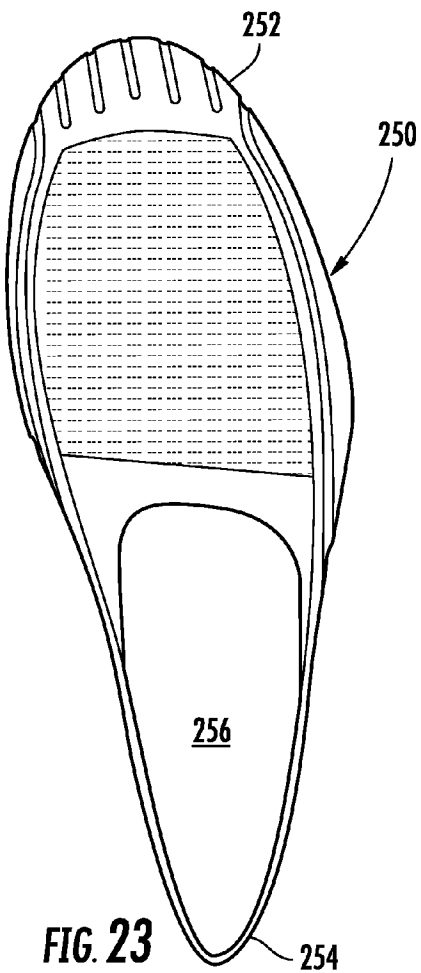
FIG. 23 is a top view thereof.
Figure 22:
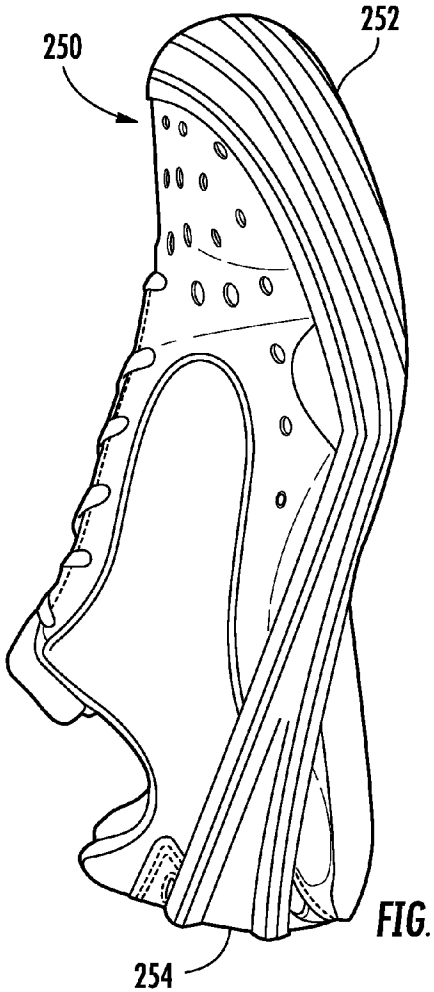
FIG. 22 is a side view thereof.
Figure 21:
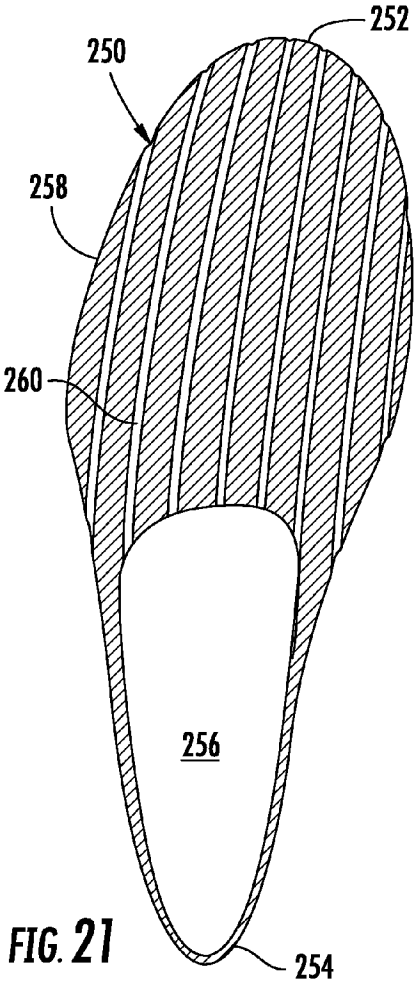
FIG. 21 is bottom view of another protective cover.

FIGS. 21-23 show another exemplary embodiment of a cleat protector 250 in accordance with the disclosure. The protector 250 is similar to the protector 200 discussed above in that it includes a front end 252, an opposing rear end 254, and a bottom 258 having treads 260 for traction. The rear end 254, however, does not fully encase the heel as in the protector 200. Here, the rear end 254 is composed of a continuous strip which extends from the front end 252, along the lateral side of the foot, around the back of the high-heel/Achilles area, and then forward along the medial side to the front end 252. In this way, the lower portion of the heel is free when protector 250 is worn. As with other embodiments discussed herein, the bottom portion 252 and particularly the interior of the bottom portion, may include contouring to facilitate receipt and retention of the cleat system at the bottom of the respective shoe.

In use, the front end 252 is pulled over the toe area of the cyclist shoe and then the rear portion 254 is stretched and extended rearwardly into a secure position over the high-heel/Achilles area of the foot. The protector 250 is removed simply by disengaging either the front or rear end 252 or 254 and then sliding the remaining end off of the cyclist shoe.

Construction of the features described above can be accomplished through various configurations. For example, as alluded to above, the ridge like feature could possibly comprise a thicker portion of material, a less malleable portion of material, a doubled over portion, or anything of the like. Also, the cleat engagement area could possibly comprise a thicker section of material, a plate or weave inserted in the material, or anything of the like.

The cleat protecting device discussed herein can be constructed in various thicknesses and of any desired material capable of producing the stated results. The protecting device need not be made of a single type of material. The device may comprise a plurality of different materials. For example, the body member may be composed of a neoprene material and the engagement area may be composed of a rubber. The device need not be one cylindrical piece or one flat piece. The device could comprise any number of pieces and configurations allowing the device as a whole to function as intended.

The illustrated exemplary embodiments have been directed thus far toward cyclist cleated shoes having a large dominant cleat on the bottom of the shoe toward the forefoot area. Of course, the broad scope of the invention contemplates applying the disclosed cleat protector to other types of cleated shoes such as, for example, football cleats, baseball cleats, golf shoes, etc.

It will be apparent to those skilled in the art that, while exemplary embodiments have been shown and described, various modifications and variations can be made to the present apparatus disclosed herein without departing from the spirit or scope of the invention. Accordingly, it is to be understood that the various embodiments have been described by way of illustration and not limitation.

What is claimed is:

1. A protective cover for a bicyclist cleated shoe, comprising:

a thin flexible body member having a hollow interior; and an engagement area disposed at the interior of the body member configured to receive and retain a cleat extending from the bicyclist shoe such that the cleat is covered by one or more of the engagement area and the body member, wherein the body member is configured to be disposed on the shoe in a position of engagement in which the cleat is received and retained at the engagement area and a position of disengagement where the body member remains secured to the shoe while the cleat is free from contact with the engagement area and is exposed for attachment to a pedal of the bicycle, and wherein the engagement area is fixedly disposed in an opening of the body member so as to extend from the interior to an exterior of the body member.

2. The protective cover of claim 1, further comprising a constrictive ridge disposed on at least one of a forward edge and rearward edge of the body member, where the constrictive ridge is configured to be positioned adjacent to the cleat when the body member is in the position of engagement to secure the body member on the shoe.

3. The protective cover of claim 1, wherein the body member includes an under foot portion and an over foot portion, the engagement area is disposed on the under foot portion, and the over foot portion is selectively attachable to the under foot portion.

4. The protective cover of claim 3, wherein the over foot portion extends from a first side of the under foot portion and includes a free end which is selectively attachable to a second side of the under foot portion.

5. The protective cover of claim 4, wherein the second side of the under foot portion includes a ring and the free end of the over foot portion comprises a hook and loop attachment arrangement, the free end being configured to be threaded through the ring and folded upon itself to engage the hook and loop arrangement to selectively attach the over foot and under foot portions.

6. The protective cover of claim 1, wherein the engagement area comprises a plurality of ribs at the interior configured to engage the cleat of the bicyclist shoe and traction elements at the exterior configured to provide traction to the cyclist while walking.

7. The protective cover of claim 6, wherein the traction elements comprise at least one of recesses formed into the engagement area and protrusions extending from the engagement area.

8. The protective cover of claim 1, wherein the engagement area comprises a plurality of individual engagement surfaces, each being fixedly disposed in an opening formed through the body member, wherein each individual engagement surface includes rib elements at the interior configured to engage the cleat and traction elements at the exterior configured to provide traction to the cyclist while walking.

9. The protective cover of claim 8, wherein the engagement area comprises three of said individual engagement surfaces arranged generally in a triangular orientation on the body member.

* * * * *